United States Patent [19]

Focaracci

[11] Patent Number: 4,646,973

[45] Date of Patent: Mar. 3, 1987

[54] IMPINGEMENT FOAMER

[75] Inventor: Julio P. Focaracci, Oakland, Calif.

[73] Assignee: The Clorox Company, Oakland, Calif.

[21] Appl. No.: 763,386

[22] Filed: Aug. 7, 1985

[51] Int. Cl.[4] ..... B05B 7/30

[52] U.S. Cl. ..... 239/428.5; 239/432; 239/343

[58] Field of Search ..... 239/314, 318, 338, 340, 239/343, 419.5, 427, 427.3, 428.5, 432, 499, 590, 590.3, 596

[56] References Cited

U.S. PATENT DOCUMENTS

| | | | |
|---|---|---|---|
| 1,192,901 | 8/1916 | Irish | 239/589 |
| 2,395,621 | 2/1946 | Funke | 239/590.3 |
| 2,774,583 | 12/1956 | Haftke | 239/427 X |
| 2,826,399 | 3/1958 | Eriksson | 239/428.5 X |
| 3,361,412 | 1/1968 | Cole III | 239/432 X |
| 3,561,536 | 2/1971 | Henshaw | 239/419.5 X |
| 3,622,049 | 11/1971 | Thompson | 239/343 X |
| 3,784,111 | 1/1974 | Piggott | 239/432 X |
| 3,946,947 | 3/1976 | Schneider | 239/428.5 X |
| 4,013,228 | 3/1977 | Schneider | 239/428.5 X |
| 4,219,159 | 8/1980 | Wesner | 239/343 |
| 4,350,298 | 9/1982 | Tada | 239/343 X |

*Primary Examiner*—Joseph F. Peters, Jr.
*Assistant Examiner*—Mary Beth O. Jones
*Attorney, Agent, or Firm*—Warren J. Krauss

[57] ABSTRACT

A process and apparatus for producing a thick foam from a spray of liquid and air. An interrupter is located in the path of a controlled portion of the outer periphery of a continuous stream of liquid. By precisely controlling the amount of peripheral flow impinged upon by the interrupter in the stream periphery, turbulence is created with consequent pressure drop and ingress of counter flowing ambient air which mixes with and causes foaming of the liquid constituent. The apparatus produces relatively large liquid particulate in air suspension. Such particulate is not readily inhaled or sensed by olfactory faculties. The dense, low velocity foaming spray which is produced adheres to target surfaces and remains in suspension eliminating dripping or running liquid.

4 Claims, 3 Drawing Figures

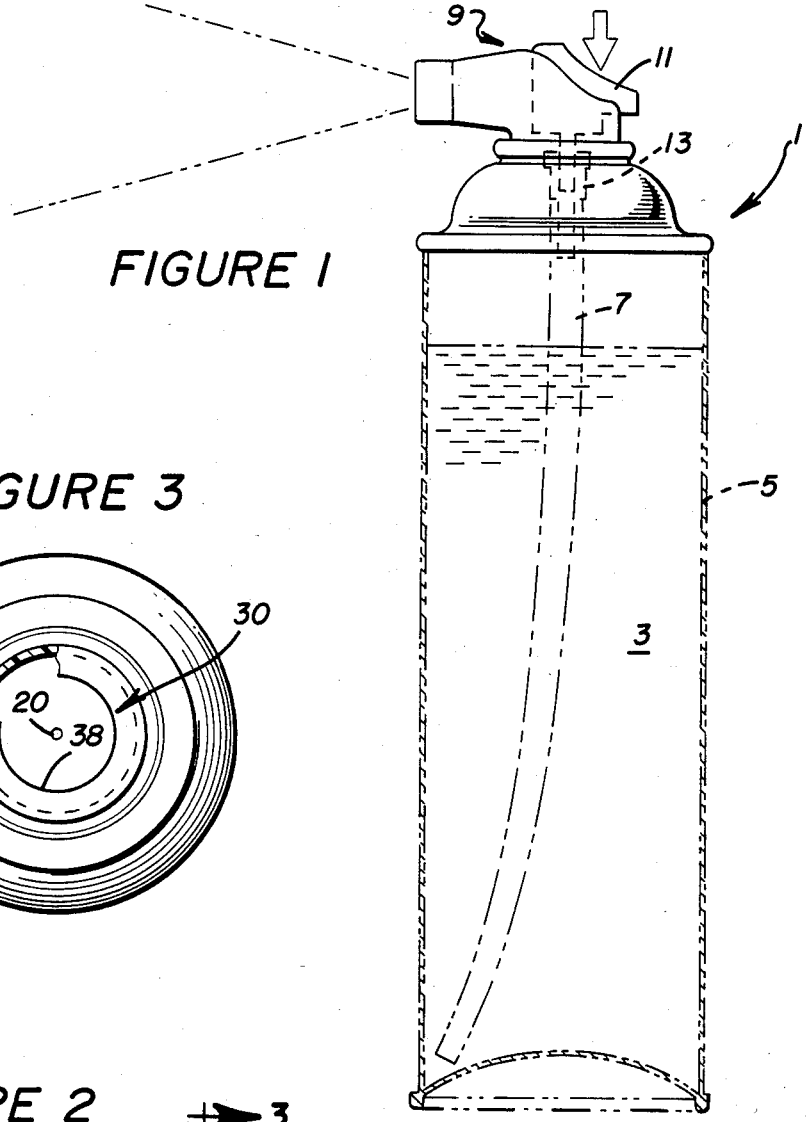
FIGURE 1
FIGURE 3
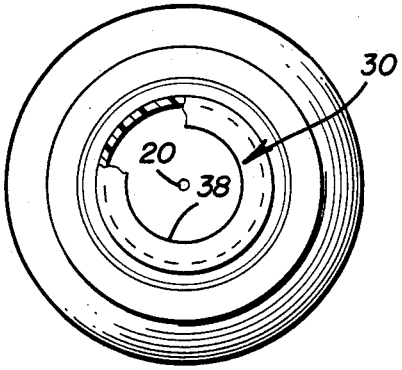
FIGURE 2
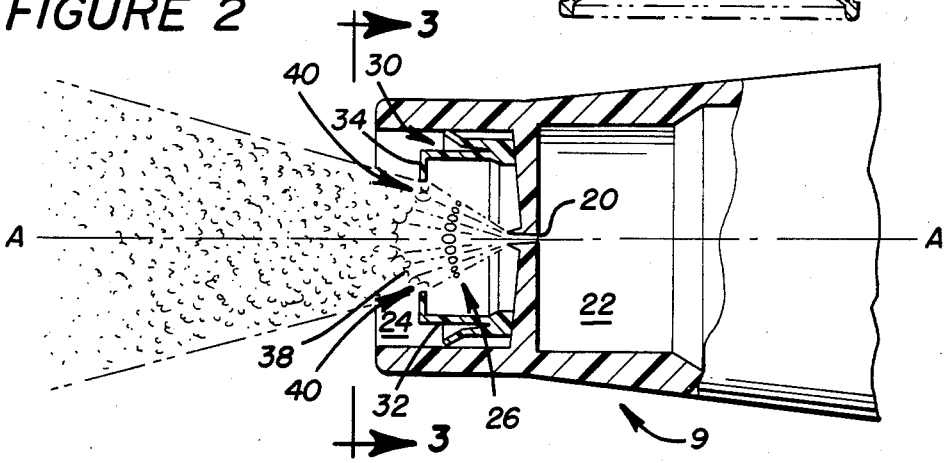

IMPINGEMENT FOAMER

BACKGROUND OF THE INVENTION

This invention relates to an apparatus and process for producing a foam suspension of liquid and air in a continuous flow liquid dispensing system.

Commercial cleaning fluids, e.g., for bathroom tiles, appliances, and the like, are dispensed from aerosol containers in which a propellant produces a continuous flow of liquid upon the actuation of a valve. Cleaning fluids can also be delivered from manual pulsating or pumping systems which deliver discrete amounts or pulses of the liquid upon an operator manually actuating a lever. This invention concerns only the continuous flow type of system The cleaning fluid dispensed by such systems often contains a powerful solvent which, while effective in removing grease and other contaminants, is extremely repugnant to the olfactory senses and eyes of the user. It has been determined as a part of the present invention that the odor and irritation level of a liquid constituent is a direct function of the degree of liquid atomization or aerosolization. That is, the smaller the liquid particulate suspended in the spray issued by the dispensing device, the more the liquid is atomized and subject to being sensed by the olfactory faculties of the user. The larger the liquid particulate size, the less odor and irritation will be sensed by the user.

Prior art systems for dispensing liquid cleaner solutions have produced liquid streams which "bounce off" the target surface (e.g., bathroom tile or the like) with consequent liquid wastage and loss of control of stream direction.

In such prior art systems, another problem has been that while a stream is moving towards the target surface, there is a continuous or periodic "dribble" of fluid immediately proximate the exit of the dispensing device.

It has been determined that one way to eliminate liquid dribbling and "bounce back" from the target surface is to produce a mixture of air and liquid particulate in the form of a "foam." Liquid dispensed in aerated foam form has been found to adhere better to a target surface and to reduce the tendency for bounce. In the prior art, however, there has not been a system which concurrently solved the aforementioned problems while increasing the particulate size, thus reducing the vapor phase of the liquid constituent to reduce odor and irritation to the user.

The present invention utilizes a "flow interrupter" which produces aerated foam by "impingement" thereof on a continuous flow liquid stream. The system is arranged so that a continuous flow of liquid is issued in a diverging spray pattern from a flow orifice. A sharp edged interrupter structure is introduced into a controlled portion of the periphery of said diverging spray of liquid such that only a controlled percentage of that periphery impinges upon the interrupter and is made to change direction with consequent turbulence. The center of the stream, inside the periphery, is not impeded and retains full energy for maximum spray distance. The turbulence created where flow reversal occurs at the stream periphery causes a drop in pressure which produces an in-flow of ambient air in a direction opposite to that of the main liquid stream.

The ambient air mixes with the liquid stream not only at the immediate areas of turbulence but also downstream of the interrupter such that the entire liquid stream becomes a low velocity, thoroughly mixed, air-liquid foam system which issues from the exit point of the apparatus.

The liquid product which issues from the apparatus contains relatively large particles of liquid in suspension with air for reduced olfactory irritation and sensation. Further, the particular design of the interrupter of the instant apparatus prevents agglomeration of liquid particulate at the point of exit so as to eliminate liquid dribbling or errant spray direction.

Numerous attempts have been made in the past for providing at least certain aspects of the advantages achieved by the present invention. For example, U.S. Pat. No. 3,946,947 to Schneider discloses a prior art method for producing foam in an atomized spray. Schneider teaches the utilization of a venturi throat downstream of a spray orifice and also downstream of a plurality of air inlet passages. In the known fashion, passage of the atomized stream through the venturi throat reduces the pressure in the throat and causes suction of air through air inlet ports which are upstream of the venturi with consequent mixing of the air and fluid in the venturi. Schneider does not teach liquid particle size management or downstream turbulence creation and air induction for creating foam.

Another example of a prior art attempt to produce foam is shown in U.S. Pat. No. 4,219,159 to Wesner. This patent discloses a rather complicated device which provides several restricter means and an impingement "screen" downstream of a spray orifice and also downstream of air inlet passages similar to the invention taught by Schneider. The Wesner apparatus provides an intermittent or pulsated flow which produces a "pumping action" for drawing in upstream air between the spray orifice and a downstream disposed flow restricting screen.

In contradistinction to the prior art systems, the present invention comprises a simple apparatus and process for interrupting only the outer periphery of an atomized spray cone so as to interfere with, only the relatively small sized liquid particles found at the periphery and to cause turbulence of only those particles to produce air induction from a source downstream of the means for interrupting the peripheral flow.

SUMMARY OF OBJECTS OF THE INVENTION

The instant foam producing process and apparatus comprises a precision flow interrupter placed in a stream of a continuous flow high pressure atomized liquid. The interrupter acts upon only the outer peripheral portion of the atomized spray stream or cone, treating only the smallest liquid particulate therein. The small particles, upon impingement with the interrupter, reverse direction and impinge upon and agglomerate with larger sized particulate in the main body of the atomized spray. The turbulence created by reversal of the flow direction of the smaller particulate causes a pressure drop which draws in ambient air from downstream of the flow interrupter. The incoming ambient air, in a direction opposite to the main flow of the atomized stream, slows the velocity of the stream while causing aeration of the larger particulate suspension with consequent production of sense, adherent foam moving at low velocity.

The primary object of the present invention is to provide an apparatus and process for quickly, efficiently, and economically creating a large-particulate, viscous foam.

Another object of the present invention is to provide an apparatus having means for impinging upon and interrupting the flow of only relatively small particulate portions of an atomized spray to cause the agglomeration of said small particles into larger particles.

A further object of the present invention is to provide a foam producing apparatus and process which interrupts the peripheral flow of an atomized liquid stream to produce turbulence with consequent low pressure production and induction of ambient air to the stream.

An additional object of the present invention is to provide an apparatus which causes turbulence in a peripheral portion of an atomized stream and causes induction of ambient air from a location downstream of the apparatus.

Another object of the present invention is to provide an apparatus for producing foam having a low level of small particulate to reduce vapor phase user irritation and olfactory sensation.

A further object of the present invention is to provide a foam-producing continuous flow spray apparatus which produces a viscous, low velocity foam which does not "bounce back" but rather adheres to a target surface and does not "run" or "drip" from the target area or from the spraying apparatus.

Other objects and advantages of the present invention will become apparent from the following drawing and description.

The accompanying drawing shows, by way of illustration only, the preferred embodiment of the present invention and the principles thereof. It should be recognized that other embodiments of the invention, applying the same or equivalent princiles, may be used and that structural changes may be made as desired by those skilled in the art without departing from the spirit of the invention.

BRIEF DESCRIPTION OF THE DRAWING

FIG. 1 is a partial sectional elevation of a continuous low fluid atomizer system embodying the foaming spray apparatus which is the subject of this invention;

FIG. 2 is a detailed sectional view of the main components of the instant apparatus;

FIG. 3 is an end view of the apparatus taken along the line 3—3 of FIG. 2.

DETAILED DESCRIPTION

With reference to FIG. 1 in the drawing, a continuous flow liquid product delivery system embodying the present invention is shown generally at 1. The liquid product 3 is contained by a pressurized receptacle 5 in the known fashion. Liquid delivery tube 7 is disposed interiorally of the receptacle for transmitting liquid from the receptacle to the spray foamer apparatus, shown generally at 9. A trigger or lever 11, when depressed in the direction of the arrow, opens a common valving mechanism 13 to release a continuous flow of liquid under pressure from the tube to the atomizing aperture of the apparatus.

With reference to FIG. 2, a detailed view of the atomizer orifice and related apparatus is provided. The atomizer orifice is illustrated at 20. It communicates liquid, which has entered a chamber 22 from the delivery tube 7, to the ambient. The atomizer orifice is illustrated in cross section as a diverging channel, of molded plastic or the like, which communicates between chambers 22 and 24.

Illustrated generally at 26 is the flow pattern of atomized spray which issues from the atomizer orifice. It may be seen that the spray, in the form of a cone, contains particles of liquid of sizes varying from very small to large droplets. It has been shown through testing that liquid particle size varies in the spray cone inversely with the increasing distance from the center line A—A of the atomizer orifice in the direction of flow. That is, the largest liquid droplets lie along the center line whereas the smallest, most easily vaporized particles, lie at the outer periphery of the spray pattern. At normal use conditions, the majority of readily vaporized small particulate liquid lies within the outer approximately 10 percent of the periphery of the stream.

With particular reference now to FIGS. 2 and 3, the sharp edged flow interrupter of the present invention may be appreciated. In the embodiment shown, the interrupter 30 takes the form of a cylindrical member having a wall portion 32 and a face portion 34 which face portion is perforated at 38 to form a circular, sharp edged orifice.

With reference to FIG. 3, it may also be appreciated that the atomizer orifice 20 is circular and produces a circular section, conical liquid flow pattern in the product emitted therefrom.

With reference to FIG. 2, it may be appreciated that, depending upon the size of the orifice 38 created by perforation of the face 34, more or less of the peripheral portion of the liquid flow cone issuing from the atomizer orifice 20 can be interrupted. It has been determined that the optimum percentage of the periphery of the conical pattern which is interrupted is 10 percent.

If the interrupter orifice 38 is made smaller so as to impinge upon more than 15 percent of the peripheral flow of the spray, and enough of the aforementioned large sized particles are impinged, a "dripping" of liquid product can occur just beyond the outlet of the interrupter orifice 38. If the orifice 38 is made larger such that 5 percent or less of the outer periphery of the flow pattern is interrupted, then too little turbulance is created for the requisite pressure drop and counter air flow from downstream of the interrupter orifice 38 to produce the particle agglomeration and aeration factors which are at the heart of this invention.

Thus, there is a critical relationship between the size of the spray cone formed by the atomizer orifice and the size of the interrupter orifice The relationship must be such as to produce an interruption of only approximately 10 percent of the perihery of the conical flow spray. As the tolerance increases on either side of the ideal point, the efficiency, aeration, and foam formation factors reduce.

Critical to the purposes of the present invention is the in-flow of ambient air from downstream of the interrupter orifice. with reference to FIG. 2, the air flow direction is illustrated by the bold arrows 40. Ambient air is drawn in, as shown by the arrows, because a pressure drop is created as the atomized spray strikes the inner portion of the interrupter face 34. Air is drawn into the chamber 26 over the sharp edge of the orifice 38 and mixing occurs both within the conical spray pattern and within the chamber 26. The orifice 38 is the sole means of ingress of ambient fluid to the chamber 26. The mixture which is eventually emitted from the orifice 38 is comprised of only large sized particulate, highly aerated to form low velocity foam. The small dimension particulate which had formerly existed at the outer periphery of the flow spray would have been agglomerated into larger particles.

Thus, the preferred embodiment of the invention has been illustrated and described. It must be clearly understood that the preferred embodiment is capable of variation and modification and is not limited to the precise details set forth. For instance, it is apparent that the shape of the interrupter orifice 38 is dependent upon the shape of the flow stream issuing from the atomizer orifice. If, for example, the atomizer orifice was square in section instead of circular, then the interrupter orifice would also be formed as a square projection and dimensioned so as to interrupt only approximately 10 percent of the outer periphery of the flow stream issued by the atomizer orifice. This invention contemplates all such variations and modifications as fall within the scope of the appended claims.

I claim:

1. A system for foaming a flowing liquid stream, including, in combination; liquid supply means for selectively supplying a stream of liquid under pressure, first chamber means for receiving said stream of liquid from said liquid supply means, second chamber means for receiving said stream of liquid from said first chamber means, first orifice means disposed between said first and second chamber means for directing said stream of liquid from said first chamber means to said second chamber means in a shaped spray pattern, flow interrupter means disposed within said second chamber means for selectively impinging upon a selected portion of said shaped spray pattern and creating turbulence in said stream in locations where said impingement occurs, said flow interrupter means forming third chamber means located within said second chamber means and including second orifice means for communicating said shaped spray pattern to the ambient, said turbulence being created proximate said second orifice means and wherein said second orifice means includes means for communicating ambient fluid from a location downstream of said second orifice to said third chamber means, said second orifice means being the sole means for communicating said ambient fluid to said third chamber means.

2. The invention of claim 1 wherein said first orifice means includes a circular cross-section diverging channel for producing a shaped spray pattern of diverging conical shape.

3. The invention of claim 2 wherein said second orifice means is disposed and dimensioned so as to impinge upon the range of 9–11% of the peripheral portion of said conical shaped spray pattern.

* * * * *